United States Patent [19]

Usui

[11] 4,196,505

[45] Apr. 8, 1980

[54] METHOD OF MANUFACTURING HIGH PRESSURE FUEL INJECTION PIPES

[75] Inventor: Masayoshi Usui, Numazu, Japan

[73] Assignee: Usui Kokusai Sangyo Kabushiki Kaisha, Shizuoka Japan

[21] Appl. No.: 944,019

[22] Filed: Sep. 20, 1978

[30] Foreign Application Priority Data

Nov. 15, 1977 [JP] Japan ..... 52-137460

[51] Int. Cl.[2] ..... B22D 11/126

[52] U.S. Cl. ..... 29/526.5; 72/275

[58] Field of Search ..... 29/526.2, 526.4, 526.5, 29/527.6, 157 C, DIG. 6, DIG. 11, DIG. 13; 72/274, 275, 283, 368, 370

[56] References Cited

U.S. PATENT DOCUMENTS

| | | | |
|---|---|---|---|
| 1,242,127 | 10/1917 | Bell | 29/526.5 |
| 1,607,475 | 11/1926 | Otto | 29/526.5 |
| 1,987,201 | 1/1935 | McAllister | 29/526.5 |
| 3,259,975 | 7/1966 | Chapman | 29/527.7 |
| 3,293,894 | 12/1966 | Edgecombe et al. | 72/283 |

FOREIGN PATENT DOCUMENTS

| | | | |
|---|---|---|---|
| 576730 | 5/1959 | Canada | 29/526.2 |
| 734336 | 10/1932 | France | 72/275 |
| 48-93569 | 12/1973 | Japan | 72/275 |
| 52-756 | 1/1977 | Japan | 72/275 |

*Primary Examiner*—Milton S. Mehr

*Attorney, Agent, or Firm*—Anthony J. Casella

[57] ABSTRACT

This invention is made with a view to remarkably improving the smoothness of the inside surface of the hole of a high pressure fuel injection pipe to be used for Diesel internal combustion engines and to improving the true circularity of the hole shape and the uniformity of the hole diameter and is a method of manufacturing high pressure fuel injection pipe materials characterized by forming a pipe body by cutting and removing an interposed slag layer collected and deposited near the center of a steel bar material in the steel bar direction and then gradually elongating the pipe body to be of desired dimensions by the repetition of an annealing treatment in a non-oxidizing or reducing atmosphere and a drawing and reducing treatment by using both die and plug.

2 Claims, 4 Drawing Figures

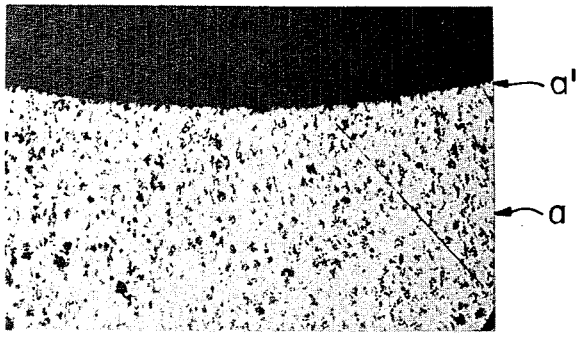
FIG. 1
FIG. 2
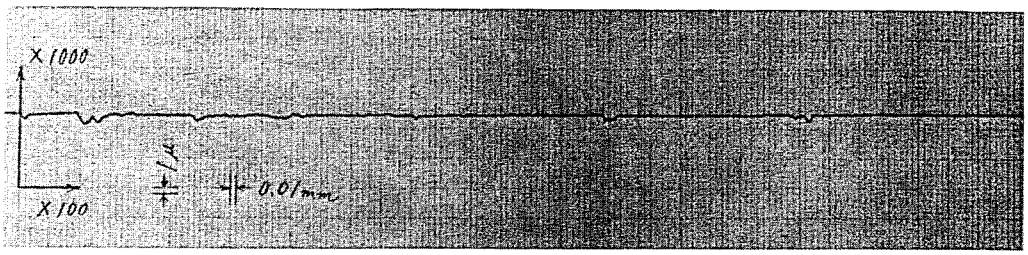
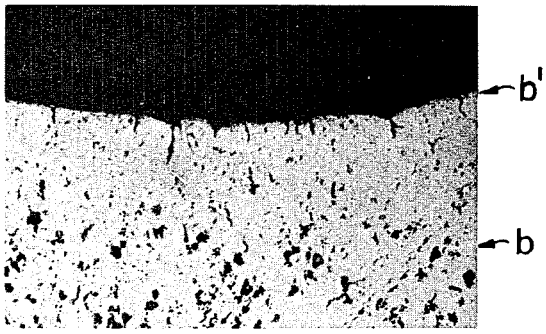
FIG. 3
FIG. 4
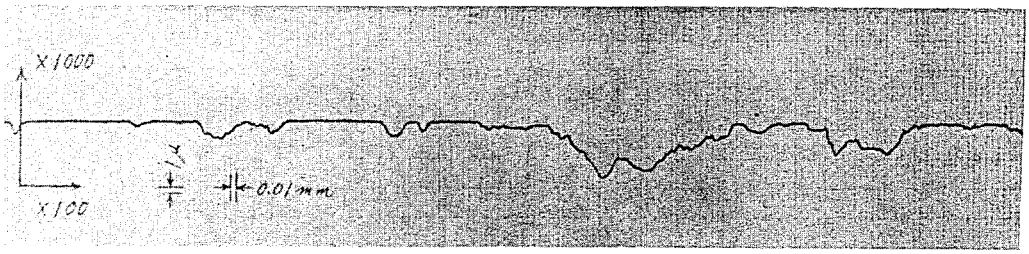

METHOD OF MANUFACTURING HIGH PRESSURE FUEL INJECTION PIPES

BACKGROUND OF THE INVENTION

1. Field of the Invention

The present invention relates to a new method of manufacturing high pressure fuel injection pipe materials to be used mostly for fuel feeding pipes for Diesel internal combustion engines and is made with a view to greatly improving the smoothness (coarseness) of the inside surface of the hole of an injection pipe and to improving the true circularity of the hole shape and the uniformity of the hole diameter.

2. Description of the Prior Art

In conventionally manufacturing a high pressure fuel injection pipe material, a carbon steel pipe obtained by hot-drawing is used to make a desired pipe by the repetition of annealing and drawing it. However, by the influence of a black skin layer or hair crack layer present on the inside surface of the hole of the pipe material, the inside surface of the hole of the pipe lacks in the smoothness, the hole shape lacks in the true circularity and the uniformity of the hole diameter and no satisfactory pipe is obtained. Therefore, the chemical treatment of the inside surface is attempted before annealing and drawing it. However, the precision required of the product is so strict that, even by such treatment, no satisfactory one is obtained today. (As the prior arts there are, for example, Japanese Patent Laid-Open Prints No. 93569/48 and No. 756/52.)

SUMMARY OF THE INVENTION

The present invention has solved such problems and its subject matter is a method of manufacturing high pressure fuel injection pipe materials characterized by forming a pipe body by cutting and removing an interposed slag layer collected and deposited near the central part of a steel bar material in the pipe direction and then gradually elongating the pipe body to be of desired dimensions by the repetition of annealing it in a non-oxidizing or reducing gas atmosphere and drawing and reducing it by using both die and plug.

That is to say, the method of the present invention is a success in obtaining at a high precision the smoothness of the inside surface of the hole, the true circularity of the hole shape and the uniformity of the hole diameter by forming a pipe body by using as a material a steel bar material instead of a high pressure carbon steel pipe made by hot-drawing and removing an interposed slag layer present near the central part of said steel bar material and repeating annealing said pipe body in the conventional manner and drawing and reducing it by using both die and plug.

The slag is composed of $SiO_2$, $Al_2O_3$, $MnO_2$ and others. The interposed slag layer formed by the deposition of them near the central part is not uniform in the cross-sectional area but is cut and removed so as to form a circle concentric with the steel bar material. According to the experience by the present inventor, a favorable result is obtained by removing 30 to 80% of the diameter of the steel bar material. The degree of this removal is determined by the microscopic inspection of the cross-section of the steel bar material before cutting. Further, this determination is made by a proper extraction inspection of each lot.

In the present invention, a steel bar material is thus used, therefore there is no such fear of a black skin layer or hair crack layer as in the case of the conventional method, an injection pipe material made in a high precision is obtained and the utility is high.

BRIEF DESCRIPTION OF THE DRAWINGS

The drawings show the results of the inspection of inside surfaces of pipe materials obtained by the later mentioned example and control.

FIG. 1 is a magnified photograph (by 200 times as large) of a part of the section on the inside surface side of an injection pipe material obtained by the present invention.

FIG. 2 is a measured diagram of the smoothness of the hole of the same pipe material.

FIG. 3 is a magnified photograph (by 200 times as large) of a part of the section of a control pipe.

FIG. 4 is a measured diagram of the smoothness of the hole of the control pipe.

Detailed Description of the Invention

The abscissa in this measured diagram indicates the movement in the peripheral direction on the inner surface of the pipe material. The ordinate indicates the irregularities measured in the diametrical direction of the tubular member at the respective points of the above peripheral movement. In FIG. 2, the abscissa shows values of 100 times and therefore its one section shows 0.01 mm and the ordinate shows valves of 1000 times and therefore its one section shows 1 micron. FIG. 3 is a magnified photograph (by 200 times as large) of a part of the section on the inside surface side of a conventional product in the later mentioned control. FIG. 4 is a measured diagram of the smoothness of the hole of said conventional product, which is explained the same as in FIG. 2.

By the way, a is the section on the inside surface side of the injection pipe material obtained by the method of the present invention, a′ is the inside surface of the same, b is the section on the inside surface side of the injection pipe material obtained by the conventional method in the later mentioned control and b′ is the inside surface of the same.

EXAMPLE 1:

[Raw steel material]

Steel bar material of AISI 1010, an outside diameter of 17.5 mm and a length of 600 mm.

[Interposed slag layer removing step]

The interposed slag layer present near the central part of the above mentioned steel bar material was inspected and measured by the microscopic inspection of the section. Said layer was cut and removed by using a cutting machine at a cutting velocity of 70 mm/min and a feeding velocity of 200 mm/min to obtain a pipe body of an outside diameter of 17.5 mm, inside diameter of 11.0 mm and thickness of 3.25 mm.

[Pipe body annealing and elongating step]

Then said pipe body was annealed by being passed at a velocity of 300 mm/min in 8 minutes through an electric annealing furnace having an atmosphere of an ammonia decomposition gas and having the internal temperature kept at 950° C. and was then elongated by using both die and plug in the ordinary manner.

When the above annealing and elongation of the pipe body were treated as mentioned in Table 1, a high pressure fuel injection pipe of an outside diameter of 6.0 mm and a thickness of 2.0 mm was obtained.

Table 1

Table 1

| | | Outside diameter | Thickness |
|---|---|---|---|
| Original pipe body | | 17.5mm | 3.25 |
| Elongation of pipe | First step | 12.1 | 2.95 |
| | Second step | 9.0 | 2.50 |
| | Third step | 6.0 | 2.0 |

Note:
The original pipe body was obtained by removing from the steel bar material the slag layer present near its central part.

[Inspection of the inside surface of the product]

The section a on the inside surface side of the obtained injection pipe material of an outside diameter of 6.0 mm and a thickness of 2.0 mm is shown in FIG. 1. When it is compared with the section b on the inside surface side illustrated in FIG. 3 mentioned in the control, the difference in the smoothness between both inside surface a' and b' will be remarkable.

FIG. 2 shows that the smoothness of the inside surface a' of the pipe material illustrated in FIG. 1 is 2 microns. FIG. 4 shows that the smoothness of the inside surface b' of the pipe material illustrated in FIG. 3 is 9 microns. Thus the difference in the smoothness between the respective inside surface a' and b' of both pipe materials is remarkable. Such smoothness is obtained by the provision of the coarseness test of JIS B0601.

Control:

An injection pipe material of an outside diameter of 6 mm and a thickness of 2 mm was obtained by annealing and elongating a hot-drawn steel pipe in the same manner except that the hot-drawn steel pipe having a black skin on the inside surface was used instead of the pipe body obtained from the steel bar material in Example 1 and was chemically treated on the inside surface in the conventional manner to have the black skin removed.

The section b of the thus obtained pipe material and the smoothness of its inside surface b' were respectively as illustrated in FIGS. 3 and 4.

I claim:

1. A method of manufacturing a high pressure fuel injection pipe from an elongated, round bar of steel bar material comprising the steps of:

forming a pipe body by cutting between 30 to 80% of the central diameter portion of the bar to remove the interposed slag layer collected and deposited near the center portion of the bar along the length thereof; and gradually elongating said pipe body to be of desired dimensions by the repetition of an annealing treatment wherein the pipe body is passed through an electric annealing furnace having a non-oxidizing or reducing atmosphere and an internal temperature kept at approximately 950° C., and a drawing and reducing treatment by using both die and plug.

2. A method of manufacturing a high pressure fuel injection pipe from an elongated, round bar of steel bar material as in claim 1 wherein said electric annealing furnace has an atmosphere of an ammonia decomposition gas.

* * * * *